United States Patent [19]

Eisenlohr et al.

[11] 4,260,47

[45] Apr. 7, 198

[54] PROCESS OF PRODUCING HYDROCARBONS FROM COAL

[75] Inventors: Karl H. Eisenlohr, Buchschlag; Hans Gaensslen, Frankfurt am Main, both of Fed. Rep. of Germany

[73] Assignee: Metallgesellschaft Aktiengesellschaft, Frankfurt am Main, Fed. Rep. of Germany

[21] Appl. No.: 117,137

[22] Filed: Jan. 30, 1980

Related U.S. Application Data

[63] Continuation of Ser. No. 931,349, Aug. 7, 1978, abandoned.

[30] Foreign Application Priority Data

Aug. 9, 1977 [DE] Fed. Rep. of Germany ..... 2735829

[51] Int. Cl.[3] ..... C10G 1/00; C10G 1/06; C10J 3/00

[52] U.S. Cl. ..... 208/8 LE; 208/10; 48/210

[58] Field of Search ..... 208/8 LE, 10; 48/210

[56] References Cited

U.S. PATENT DOCUMENTS

| | | | |
|---|---|---|---|
| 1,055,334 | 3/1913 | Laird | 48/210 |
| 2,595,338 | 5/1952 | Creelman | 48/210 X |
| 3,617,465 | 11/1971 | Wolk et al. | 208/8 LE |
| 3,635,814 | 1/1972 | Riene et al. | 208/10 |
| 3,932,146 | 1/1976 | Wilson et al. | 48/210 |
| 3,957,459 | 5/1976 | Mitchell et al. | 48/210 |
| 3,985,519 | 10/1976 | Kolina et al. | 48/210 |
| 4,017,270 | 4/1977 | Funk et al. | 48/210 |
| 4,050,908 | 9/1977 | McNamee et al. | 48/2 |

OTHER PUBLICATIONS

British Chemical Engineering, (1) May 1957, p 238–244, (2) Jun. 1957, pp. 308–312, (3) Jul. 1957, p 368–373 and pp. 418–419 in Aug. 1957, Hoogendoorn al.

*Primary Examiner*—Delbert E. Gantz
*Assistant Examiner*—William G. Wright
*Attorney, Agent, or Firm*—Sprung, Felfe, Horn, Lync & Kramer

[57] ABSTRACT

An improvement in a process for producing hydroca bons which boil in the gasoline or diesel fuel range fro coal where the coal is reduced to a particle size belo 2 mm, mixed with oil to form a pumpable pulp which contacted with hydrogen in a hydrogenation zone r sulting in a liquid fraction and a high melting residu fraction is disclosed. The invention resides in removin the high melting residue to a gasifying vessel to whic is introduced granular coal of particle size of 3–50 mn To the gasifying vessel is added a gasifying agent, e.g water vapor alone or in admixture with oxygen whic flows in countercurrent to the direction of the granul coal. As a result of the process, a gasification product obtained comprising hydrogen and carbon monoxide.

8 Claims, 1 Drawing Figure

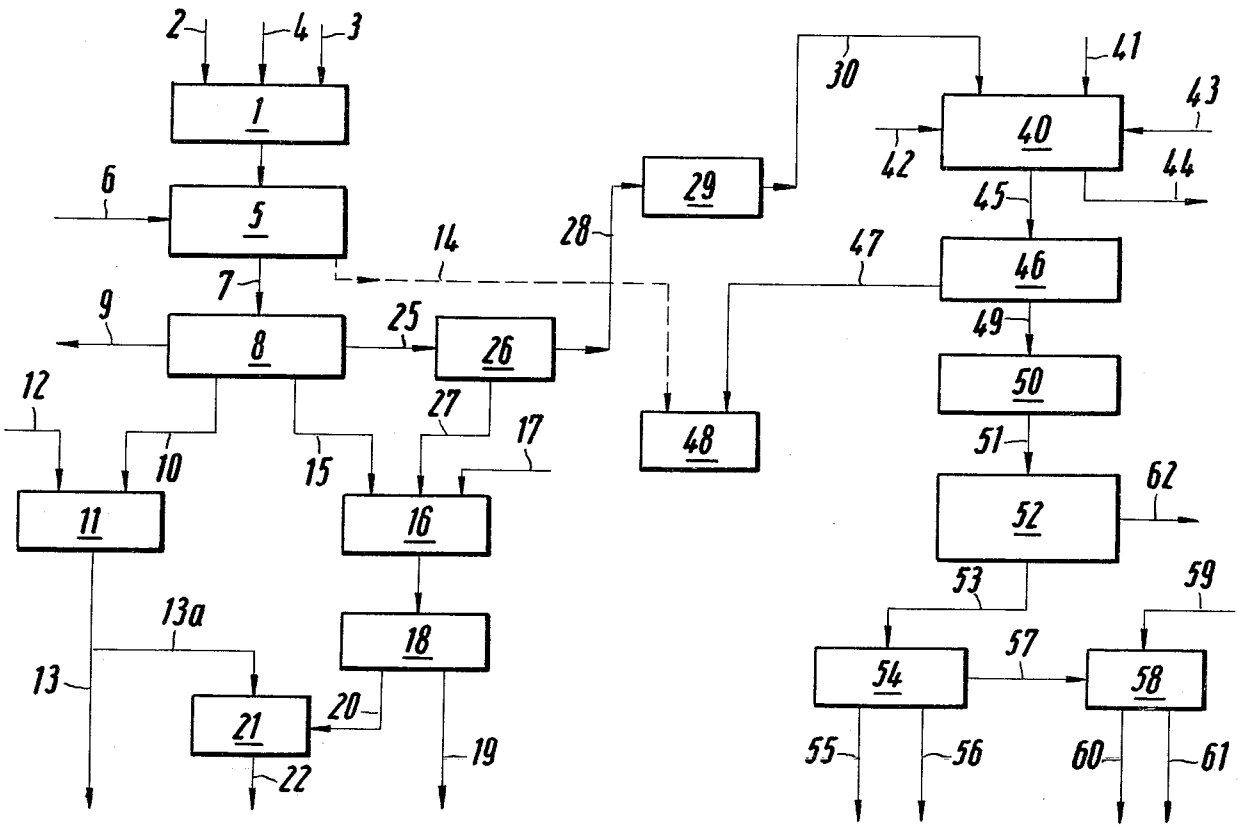
1
2
3
4
5
6
7
8
9
10
11
12
13
13a
14
15
16
17
18
19
20
21
22
25
26
27
28
29
30
40
41
42
43
44
45
46
47
48
49
50
51
52
53
54
55
56
57
58
59
60
61
62

PROCESS OF PRODUCING HYDROCARBONS FROM COAL

This is a continuation of application Ser. No. 931,349 filed Aug. 7, 1978, now abandoned.

This invention relates to a process of producing hydrocarbons which boil in the gasoline and diesel fuel ranges, from coal, in which the coal is reduced in size and in a particle size below 2 mm is mixed with oil to form a pumpable pulp and in a hydrogenating zone is reacted in the presence of hydrogen under a pressure of 100 to 400 bars and temperatures of 300° to 500° C., and the product formed in the hydrogenating zone is separated into fractions, which include liquid components, which consist mainly of hydrocarbons having 4 to 30 carbon atoms per molecule and are processed to form motor fuels, if desired, and a high-melting residue, which contains pitch and solids and is withdrawn.

It is known to hydrogenate various kinds of coal, including brown coal, and to process the hydrogenation products to form motor fuel. A comprehensive treatment of this technology is contained in the book by H. Krönig: "Die katalytische Druckhydrierung von Kohlen, Teeren und Mineral-ölen" (1950), Springer-Verlag, Berlin-Göttingen-Heidelberg. More recent developments have been described in U.S. Pat. Nos. 3,745,108; 3,660,269; and 3,635,814. In the known processes a catalyst is used or is not used in the hydrogenating zone. Processes using no catalyst utilize in most cases the catalytic activity of metallic constituents of the coal. For a hydrogenating of coal, it is important that the coal fed to the hydrogenating zone has been disintegrated to a very small particle size so that large surface areas are presented to the hydrogen. Any catalyst must also be used in a small particle size and mixed with the coal.

The product of the hydrogenating zone contains gaseous, liquid and solid constituents, which are usually subjected first to fractional condensation, which may be succeeded by a distillation. A high-melting residue, which contains pitch and solids, is thus formed and is not suitable for re-hydrogenation. On the other hand, the hydrocarbon-containing liquid can be processed in a hydrocracker and/or hydrotreater by known methods in the presence of hydrogen and possibly catalysts to produce motor fuel.

In this specification the term motor fuel includes mainly regular-grade gasoline (low-octane petrol), premium-grade gasoline (high-octane petrol), diesel fuel, and kerosene.

It is an object of the invention to convert available coal as completely as possible to valuable hydrocarbons. This is accomplished in that the residue together with granular coal having a particle size of 3 to 50 mm is gasified in a fixed bed under pressures of 10 to 100 bars by a treatment with gasifying agents flowing in a countercurrent to the coal, the gasification product gas, which contains hydrogen and carbon monoxide, is cooled, tar and oil are withdrawn as condensate, and the gas is purified.

In the known hydrogenating processes it has always been difficult to dispose of the high-melting residue. It has already been considered to process that residue by coking, dry distillation or solvent extraction. The process according to the invention, in which the residue is gasified together with granular coal, is much simpler than the processes suggested before.

After purification, the gasification product can used for various purposes. It can be processed further produce a synthesis gas from which a gas having a hi calorific value can be produced, e.g., by methanati The purified gas may also be shift-converted and us as a source of hydrogen for hydrogenating the coal.

The high-melting residue may be subjected to t gasification in a liquid state together with the coal. It particularly advantageous, however, to granulate t residue and to subject a residue having particle sizes the range from 3 to 50 mm to gasification. Surprising it has been found that the granules are not melted, would be expected, but retain their shape when they a heated during the gasification in the fixed bed. If t residue is granulated it is not necessary to find out hc a solidification of the residue in the hydrogenating pla can be avoided in a reliable manner.

The process according to the invention may be a plied to various kinds of coal, including pit coal a brown coal. In a preferred embodiment of the proce the product gas obtained by the gasification of granul coal and high-melting residue is purified and then fed a Fischer-Tropsch synthesis section for producing h drocarbons which at least in part contain 4 to 30 carb atoms per molecule. The production of hydrocarbo along two interconnected routes comprising the hydr genation of coal and the Fishcer-Tropsch synthe constitutes a versatile overall process. If one of the tv routes fails entirely or in part for certain time, the pr duction can be continued on the route which is st intact. For instance, when the coal-gasifying secti must be shut down, the operation of the co hydrogenating section may be continued. In that ca the high-melting residue is preferably dumped in a gr nulted state. A further advantage residues in that a hig ash coal can be used, which is fed to the coal-gasifyi section, whereas low-ash coal is desired for the hydr genating section.

By the Fischer-Tropsch synthesis, synthesis gas co taining mainly CO and $H_2$ is reacted at pressures of 5 30 bars and temperatures in the range from 150° to 35 C. to produce hydrocarbons. The synthesis is suitab effected in the presence of catalysts which contain, e.g cobalt, manganese or iron as active component or act vators. The Fischer-Tropsch synthesis is known in itse and has been described, e.g., in the book by Storc Golumbic, Anderson: "The Fischer-Tropsch and R lated Synthesis", (1951) John Wiley and Sons, Ne York.

The Lurgi process may be used for the gasification coal. Details of that process have been explained in U.S Pat. Nos. 2,667,409; 3,930,811; 3,937,620; 4,032,030; an 4,033,730. The gasification of granular coal provides fo a processing of coal having a suitable particle size an for a processing of the coal dust, which is always pre ent and is subjected to hydrogenation.

In addition to the ash contained in the coal, the pr cess according to the invention does not result in soli residues because all residues formed in the coa hydrogenating section can be fed to the gasifying se tion. The primary product of the Fischer-Tropsch sy thesis can readily be converted to motor fuel. For th production of high-grade motor fuel from the produ of the hydrogenation of coal, said product must b catalytically refined and at least part of the refine products must be cracked in the presence of hydroge and catalysts. These treatments can be effected in acco dance with processes which are known in refinery tec ogy. The refining stages may also be fed with tar and which become available as condensates when the / gas produced by the gasification of coal is cooled in ›s.

ail gases which become available in the hydrogenat- section and/or the Fishcer-Tropsch synthesis sec- ı can be converted to a high-hydrogen gas, from ich the hydrogen is separated and fed to the hydro- ıating stage. For instance, the tail gas may be catalyt- ly or noncatalytically reformed by a treatment with lrogen so that the product gas contains mainly CO l $H_2$. This gas can be shift-converted by a treatment h water vapor so that the CO content of the gas is ıverted to $H_2$ and $CO_2$ and $CO_2$ can then be scrubbed Alternatively, $H_2S$, $CO_2$, and $NH_3$ may be removed m the tail gases and the latter can then be separated low temperatures to recover the hydrogen for the lrogenating. $C_3$ and $C_4$ hydrocarbons become avail- e at the same time as liquefied gas.

urther details of the process will now be explained h reference to the drawing, which is a flow scheme. The stage 1 for pretreating the coal is fed by a con- ›or 2 with pre-crushed coal having substantially a ticle size below 2 mm and is fed through conduit 3 h oil having a boiling range of about 250° to 450° C. the pretreating stage 1, the coal is further disinte- ted and intensely mixed with oil. For this reason the treating stage is suitably fed also with fine-grained alyst material through conduit 4. The catalyst rate is › 10% by weight of the coal feed rate. The catalyst elerates the hydrogenation in the hydrogenating ıe 5.

A pumpable pulp consisting of coal, oil and catalyst ves the pretreating stage 1 and is fed to the hydroge- ing zone 5. In addition to oil, the pump contains ›ut 30 to 60% solids. Hydrogen is fed to the hydroge- ing zone 5 through conduit 6. The pressure in the lrogenating zone is 100 to 400 bars, preferably 120 to › bars, and the temperatures are in the range from ›° to 500° C. and preferably at 400° to 475° C. The jor reactants consisting of coal, hydrogen catalyst terial are intensely contacted with each other in the lrogenating zone 5.

The resulting main product is transferred from the lrogenating zone 5 through a conduit 7 to a separator n which the liquid and vapor phases are separated t at temperatures of about 400° to 450° C. The lique- ›le hydrocarbons are separated from the gas stream fractional condensation. Uncondensed tail gas is hdrawn in conduit 9. The condensible components separated by distillation in the separator and a frac- ı to boiling in the range of 30° to 250° C., preferably to 200° C., under standard pressure, is transferred in ıduit 10 to a hydrotreater 11, which is fed also with lrogen from conduit 12 and in which a catalytic ıversion and desulfurization are effected by pro- ses known per se. As a result, gasoline which is suit- e as a motor fuel becomes acailable in conduit 13. To rease its octane rating, all or part of that gasoline y be fed in conduit 13a to an aromating stage 21, the ›duct of which becomes available in conduit 22.

A higher-boiling fraction, which has a boiling point ıt least 230° C. at normal pressure, is withdrawn from separator 8 through conduit 15 and is cracked in a lrocracker 16 in known manner in contact with hy- ›gen from conduit 17. The cracking is preferably elerated by catalysts. The product formed in the lrocracker 16 is separated in a distillation stage 18 and the heavier fraction is withdrawn in conduit 19 as diesel fuel. The lighter fraction is fed in conduit 20 to the aromating stage 21. Gasoline is withdrawn in conduit 22.

In the separator 8, hot sludge becomes available at temperatures of about 400° to 450° C. That sludge contains unreacted coal, high-boiling oil and any catalyst material used for the hydrogenation. That sludge is fed through conduit 25 to a vacuum distillation stage 26 and is further separated therein. The lowerboiling fraction is fed in conduit 27 also to the hydrocracker 16. A high-melting residue is left, which contains pitch and solids and is fed in conduit 28 to a granulator 29. the granulated residue is fed by a conveyor 30 to a pressure gasifier 40, which is also fed by the conveyor 41 with granular coal having a particle size in the range from 3 to 50 mm. In the gasifier 40, the coal to be gasified is in a fixed bed and flown through in a countercurrent by gasifying agents fed from below. The gasifying agents consist of water vapor fed through conduit 42 and oxygen fed through conduit 43. In addition to these gasifying agents, $CO_2$ may be used. This is not shown on the drawing.

The coal gasifier 40 operates under pressures in the range from 10 to 100 bars, preferably 15 to 50 bars. Ash is withdrawn from the pressure gasifier through conduit 44. That ash contains also the catalyst which has been used in the hydrogenating zone 5. Raw product gas at a temperature of about 300° to 800° C. leaves the gasiffier 40 through conduit 45. The raw gas is first cooled in a cooler 46, in which it is preferably prescrubbed at the same time with circulating condensate. Surplus condensate is fed in conduit 47 contains tar and oil.

The cooled gas is fed in conduit 49 to a fine purification stage 50, in which sulfur compounds as well as $NH_3$ are removed so that the gas has the purity required for the synthesis. The fine purification may be effected, e.g., by the known Rectisol process, in which liquid methanol is used as absorbent. Depending on its composition, the gas is suitably shift-converted before or after the fine purification in stage 50. By this shift conversion, the CO and $H_2$ contents of the gas are controlled as desired. Because such shift conversion is not always required, it has not been shown on the drawing for the sake of clearness.

The gas which leaves the fine purification stage 50 consists mainly of CO, $H_2$, and $CH_4$ and is fed in conduit 51 to the Fischer-Tropsch synthesis section 52, in which hydrocarbons are produced at a pressure in the range of about 5 to 30 bars and at temperatures of 150° to 350° C., preferably in the presence of catalysts. The catalysts may contain, e.g., cobalt manganese or iron as active components. The catalyst in the synthesis section 52 is preferably contained in a fixed bed and the reaction is isothermal and adiabatic. The primary product of the synthesis is separated from the gas stream by a heat exchange and cooling and flows in conduit 53 to a separator 54. Gasoline is withdrawn in conduit 55 and diesel fuel in conduit 56. A higher-boiling residue flows in conduit 57 to a wax cracker 58, in which additional gasoline (in conduit 60) and diesel fuel (in conduit 61) are produced by a treatment with hydrogen in conduit 59. This gasoline and diesel fuel are suitably refined to remove oxygen-containing compounds. This is not shown on the drawing.

Tail gases from the Fischer-Tropsch synthesis section 52 are fed in conduit 62 to a suitable use. Because tail gases which contain hydrocarbons become available elsewhere too, it is economical to process such gases. This may be accomplished by a separation at low temperatures so that the synthesis gas components C0 and $H_2$ are separated and recycled to the synthesis section 52. Alternatively, the tail gases in conduit 52 and the tail gases from the hydrogenating section may be cracked jointly to form a high-hydrogen gas.

As has been explained before, condensate which contains oil and tar is fed in conduit 47 to a tar separator 48 and is separated therein by gravity. That tar separator 48 may also be fed in the conduit 14, represented by a dotted line, with tar products from the hydrogenating zone 5. For the sake of clearness, the disposal of the fractions which become available in the tar separator has not been shown. For instance, the solids-containing heavy tar as well as distillates and condensates boiling above 250° C. may be fed through conduit 3 to the pretreating stage 1. A fraction boiling in the gasoline range may be fed to the hydrotreater 11. Higher-boiling condensates or distillates, excepting solids-containing condensates or residual oils, may be fed to the hydrocracker 16. The dust-containing heaviest fraction from the tar separator 48 may be recycled to the pressure gasifier 40.

EXAMPLE 1

Pit coal is processed by a method as shown on the drawing. The raw coal fed to the hydrogenating section has an ash content of 4.65% by weight and a water content of 2.78% by weight. The pure coal, which is assumed to be free from water and ash, has the following elementary analysis in % by weight:

C —80.44
H —4.76
O —12.37
N —1.27
S —1.16

To facilitate the explanation, all statements made hereinafter refer to pure coal. 1000 tons having a particle size below 2 mm are mixed to form a pulp in the pretreating stage 1 with 1500 tons of a hydrogenating oil fraction, which boils between 250° and 450° C. In the pretreating stage 1 the coal is further reduced in size to have a particle size below 500 microns and at least 50% of particles below 100 microns 20 tons of catalyst having the same particle size are fed to the pretreating stage 1 in the form of red mud obtained by the processing of bauxite. That red mud consists mainly of ferric hydroxide. The pulp consisting of coal, oil and catalyst is fed to the hydrogenating zone 5 and pressurized to 350 bars and heated to the reaction temperature of 460°C. The pulp is heated in the presence of hydrogen, which is supplied as fresh gas to the hydrogenating zone 5 in an amount of 65 tons through conduit 6.

55 tons of $H_2$ are chemically combined in the hydrogenating zone 5. 10 tons of $H_2$ are included in the tail gas which is withdrawn in conduit 9 from the separator and contains also the noncondensible low-boiling hydrocarbons which have been formed by the hydrogenation as well as CO, $CO_2$, $H_2S$, and $NH_3$.

The first stage of the separator 8 is operated at a temperature of 450° C. and at the operating pressure of the hydrogenating zone, amounting to 350 bars. In that first stage, 480 tons of a sludge are formed, which consists of nonevaporated hydrocarbons, unreacted coal, ash, and catalyst. This suldge is pressure-relieved in several steps and then fed to a vacuum distillation stage 26, in which 260 tons of distillate and 220 tons of a high-melting residue are formed. The latter consists 50 tons of ash, 50 tons of unreacted coal, 20 tons catalyst and 100 tons of compounds of carbon, hydı gen, oxygen, sulfur and nitrogen. The distillate is f directly to the pretreating stage 1 through conduit After the cooling in separator 3, 1740 tons of liqu products become available, which are further separat by distillation, 1240 tons of separated heavy oils are al fed to the pretreating plant 1 in conduit 3. 530 tons liquid products having a final boiling point of 440° also become available in the distillation stage and a fed in part to the hydrotreater 11 and in part to t hydrocracker 60.

The high-melting residue from the vacuum distill tion stage 26 has a melting point above 100° C. and is f to a granulator 29, in which the molten material is e truded onto a water bath through nozzles which a about 10 mm in diameter. The resulting extrusions a then crushed to a length of about 5 to 10 mm. The mo granules are mixed with coal in a ratio of 220 metı tons of granules to 897 tons of coal, calculated as pu coal. The mixture is fed to a Lurgy system pressu gasifier 40. 125 metric tons of ash, which is in lump for and contains 20 tons of hydrogenation catalyst, a withdrawn from the gasifier 40. This amount of catalı is discharged.

77 tons of tar and oil are condensed as the raw g from the pressure gasifier is cooled. The dust-containi heavy tar fraction is also fed to the pretreating stage through conduit 3. Medium-range distillate from t separator 48 is fed to the hydrocracker 16. The lo boiling fraction is refined in the hydrotreater 11. 43 to of gas naphtha become available as a result of the fi purification of the gas and are also treated in the hydr treater 11. The hydro-refined product from the hydr treater 11 and the gasoline which has been produced the hydrocracker 16 and the succeeding distillati stage 18 is fed to the aromating stage 21 for an increa of its octane rating. Hydrogen is also released in t aromating stage.

284 tons of motor gasoline and 314 tons of diesel fu are produced by the hydrogenation of coal and t processing of the products which become availat during the gasification (without the Fischer-Tropsı synthesis).

Any tail gases from the parts 5, 8, 9, 11, 16, and 18 the plant are freed from $CO_2$ and desulfurized and t gether with the sulfur-free tail gas from aromating sta 21 are separated into their components at low tempei ture and under pressure. Separated hydrogen is rec cled to the stages in which it is used. Methane and et ane are used in known manner to produce hydroge Propane can be delivered as liquefied gas. Butane used to adjust the vapor pressure of the gasoline pro uct.

The synthesis gas from the fine purification stage consists virtually only of CO and $H_2$ and some methar In a Fischer-Tropsch synthesis section 52, the synthe gas is reacted to form hydrocarbons at temperatures 220° C. and a pressure of 30 bars at an iron catalı forming a multi-stage fixed bed. The conversi amounts to 90%, based on CO and $H_2$. The reacti product is condensed from the gas stream in that t latter is first cooled to ambient temperature. Naphtha removed by a cooling below 0° C. at the operati pressure of the synthesis section. In a separator 54 gasoline fraction and a diesel fuel fraction are distill from the condensates. Before these products are del ed as motor fuels, they are slightly refined to increase e octane rating of the gasoline and to remove oxygen-ntaining components.

The distillation residue from the separator 54 consists a mix of waxlike hydrocarbons and is fed to the wax acker 58 and catalytically cracked therein in the presce of hydrogen to produce a larger amount of diesel el and a smaller amount of gasoline.

A total of 142 tons of motor gasoline and 72 tons of esel fuel are produced in the Fischer-Tropsch synthe- section.

The tail gas from the synthesis section becomes avail-le in the conduit 62 and together with the tail gas om the hydrocracker 16 is further cooled and sepa-ted under pressure. A mixture of the synthesis gas mponents CO and $H_2$ is recycled to the synthesis ate 52. Methane and ethane are reformed to produce drogen. The $C_3$ fraction is delivered as liquefied gas ter its olefins have been hydrogenated. The $C_4$ frac-n is admixed to the gasoline product.

A total of 1897 tons of pure coal, 426 tons of motor soline and 386 tons of diesel fuel are produced in the drogenation section and the Fischer-Tropsch synthe- section. In addition, 110 tons of propane are deliv-ed as liquefied gas. The yield corresponds to a thermal ficiency of 65% if the consumption of coal required to oduce energy is neglected and sulfur, ammonia, and to $C_4$ alcohols which become available as by-pro-cts of the Fischer-Tropsch synthesis are not taken to account.

Example 2

The object underlying this example is to produce ice as much Fischer-Tropsch product as in Example and to change also the ratio of diesel fuel to gasoline. The process is similar to that of Example 1.

1000 tons of pure coal are processed too, but the sified 40 is fed with 1794 tons rather than 897 tons of re coal and with 220 tons of high-melting residue. As result, additional 64 tons of tar are fed to the hydro-acker 16 and additional 16 tons of gas naphtha are fed the hydrotreater 11 so that the output of the hydroge-tion section is increased to 284 tons of motor gasoline d 364 tons of diesel oil.

The quantity of primary product of the Fischer-ropsch synthesis of Example 1 is almost doubled.

Because more diesel fuel is desired, the wax cracker is operated at somewhat lower temperatures so that ore liquid products are produced, namely, a total of 8 tons of motor gasoline and 217 tons of diesel fuel. he propane production is increased in 150 tons.

From the larger Fischer-Tropsch synthesis section, ice as much tail gas becomes available for utilization. ecause the amount of hydrogen consumed for hydro-nation is only slightly changed, the surplus tail gas n be used for power production, e.g., as gas for supply er long distances or in a gas turbine.

EXAMPLE 3

In a process which is similar to that of Example 1 the ischer-Tropsch synthesis is omitted. As has been ex-ained in Example 1, about 70 to 75 tons of hydrogen e required to hydrogenate 1000 tons of pure coal. Part that hydrogen is produced from about 60 tons of ethane produced by the hydrogenation. A high-ydrogen gas is produced from said methane by the own steam reforming process. 220 tons of high-melt-g residue and 200 tons of granular coal are fed to the gasifier 40. The gasification product gas is purified and shift-converted and then separated at low temperature to provide a high-hydrogen gas, which contains at least 95% $H_2$ by volume and can also be used for hydrogenation.

Condensate from the gasification product gas is fed to the tar separator 48, 43 tons of tar are separated in the separator 48 and fed to the hydrocracker 16. 23 tons of gas naphtha are also recovered in the tar separator 48 and are fed to the hydrotreater 11. In this process, a total of 264 tons of motor gasoline and 284 diesel fuel are produced.

What is claimed is:

1. In a process for producing hydrocarbons which boil in the gasoline and diesel fuel ranges from coal, wherein a first portion of coal is reduced to a particle size below 2 mm, mixed with oil to form a pumpable pulp, the pumpable pulp is contacted with hydrogen in a hydrogenating zone under a pressure of 100–400 bars at a temperature of 300°–500° C., the resultant hydrotreated product separated into fractions including a liquid fraction comprising mainly hydrocarbons of 4 to 30 carbon atoms per molecule and a high melting residue fraction containing pitch and solids, A. a second portion of coal having a particular size of 3 to 50 mm is fed to a gasifying vessel and is gasified in a fixed bed under pressure of 10 to 100 bars by contacting the composition with at least one gasifying agent selected from the group consisting of water vapor, oxygen, and carbon dioxide, said gasifying agent passing in countercurrent flow to the direction of movement of said second portion of coal, B. withdrawing gasification product gas comprising hydrogen and carbon monoxide from said vessel and cooling the same and withdrawing therefrom tar and oil as condensate, the gasification product gas is fed after purification to a Fischer-Tropsch synthesis section for production of primary product hydrocarbons which at least in part contain 4 to 30 carbon atoms per molecule, said primary product hydrocarbons being at least partially converted to motor fuel, the improvement which comprises withdrawing said high melting residue fraction, granulating said residue fraction to a particle size of 3 to 50 mm and feeding it into said gasifying vessel for gasification together with said second portion of coal.

2. A process according to claim 1 wherein following step B the product gas which has been freed of tar and oil is further purified.

3. A process according to claim 1 wherein the tar and oil removed are used at least in part to form said pumpable pulp.

4. A process according to claim 1 wherein the liquid fraction comprising hydrocarbons of 4 to 30 carbon atoms per molecule is thereafter treated with hydrogen in the presence of a catalyst to convert the same to a motor fuel component.

5. A process according to claim 1 wherein the tar products from said hydrogenating zone are admixed with oil and tar condensate obtained as a result of cooling said gasification product and the resulting composition is subjected to cracking.

6. A process according to claim 1 wherein the residual gases from the hydrogenating section and/or the Fischer-Tropsche synthesis section are withdrawn and converted to high hydrogen gas and the hydrogen is separated and fed to the hydrogenating section.

7. A process according to claim 1 wherein the pressure maintained within the gasifying vessel is 15–50 bars.

8. A process according to claim 1 wherein the conditions within the gasifying vessel are maintained su that the gasification product gas withdrawn from t gasifying vessel is at a temperature, prior to the cooli of step B, of 300°–800° C.

* * * * *